United States Patent [19]

Sharpe

[11] 3,950,807

[45] Apr. 20, 1976

[54] WATER SKI

[76] Inventor: Roderick P. Sharpe, Los Angeles, Calif.

[22] Filed: Apr. 4, 1975

[21] Appl. No.: 564,881

Related U.S. Application Data

[63] Continuation-in-part of Ser. No. 416,387, Nov. 16, 1974, abandoned.

[52] U.S. Cl. ..... 9/310 A

[51] Int. Cl.[2] ..... A63C 15/00

[58] Field of Search ..... 9/310 A, 310 B, 310 C, 9/310 E, 310 R; 280/11.13 F, 11.13 M, 11.13 P, 11.13 Y

[56] References Cited

UNITED STATES PATENTS

| | | | |
|---|---|---|---|
| 2,685,696 | 8/1954 | Oscanyan | 9/310 B |
| 2,991,745 | 7/1961 | Haar et al. | 9/310 B |
| 3,276,784 | 10/1966 | Anderson, Jr. | 9/310 A |
| 3,599,259 | 8/1971 | Shewmon | 9/310 A |
| D236,744 | 9/1975 | Sharpe | 9/310 A |

FOREIGN PATENTS OR APPLICATIONS

| | | | |
|---|---|---|---|
| 1,427,234 | 12/1964 | France | 9/310 A |

*Primary Examiner*—Trygve M. Blix
*Assistant Examiner*—Stuart M. Goldstein
*Attorney, Agent, or Firm*—Fulwider, Patton, Rieber, Lee & Utecht

[57] ABSTRACT

A one-piece molded plastic water ski having an elongated body of V-shaped transverse cross-section through the fore and mid sections of the ski, with the angle between the sidewalls increasing progressively toward the aft section to provide a substantially flat bottom at the aft end. The mid section has a footrest with an upper surface approximately level with the upper edges of the body, and with stirrup pieces secured thereto.

5 Claims, 5 Drawing Figures

WATER SKI

This is a continutation-in-part of co-pending application Ser. No. 416387 filed Nov. 16, 1974, entitled "Water Ski" — now abandoned.

BACKGROUND OF THE INVENTION

The present invention relates to a water ski, and has particular reference to the configuration of the water-engaging surfaces of the ski.

Conventional water skis typically are elongated boardlike members having flat, or substantially flat bottom sides for planning on the surface of the water as the skier is towed at high speed in a well-known manner. Conventional variations in bottom design include different arrangements of longitudinal grooves, some sufficiently wide to make the bottom substantially concave, and the provision of stabilizing rudder-like fins adjacent the aft ends. Less typical design variations include special configurations of the ends of skis, as illustrated by U.S. Pat. Nos. 3,061,846 and 3,599,259.

The earlier of these two patents discloses a basically conventional ski configuration with a skeg and a special front tip shape. The later patent discloses a ski which has wedge-shaped fore and aft steps for supporting the mid section of the ski above the surface of the water, during high-speed skiing. Various shapes for the undersides of the steps are disclosed, including concavely curved, convexly curved, ribbed, and V-shaped steps.

Important objectives of the various ski designs that have been proposed and used include ease of getting up on the skis and into a planing condition, ease of control, softness of ride and reduction of impacts after jumps and in choppy water, and reduction of the resistance to passage of the ski through the water. The several ski configurations that now are available have been sucessful to varying degrees in accomplishing these objectives.

SUMMARY OF THE INVENTION

The present invention resides in a novel water ski configuration that departs in concept from the previously observed rule that a water ski should be, fundamentally, a flat, board-like member, perhaps with modifications in its basically flat underside for improved performance. Instead, the ski of the present invention has a body which is of V-shaped transverse cross-section in the fore and mid sections of the ski, so as to have a relatively narrow keel and a relatively wide upper side, the forward end being tapered and pointed like the bow of a boat. The sidewalls preferably are substantially planar aft of the bow, but some vertical curvature in cross-section is permissible.

In addition to reducing the impacts after jumps and in choppy water, for a much softer ride, the V-shaped body configuration has the very important advantage of riding progressively farther out of the water and reducing the "wetted width" of the bottom surface as speed increases, thus progressively reducing the frictional drag on the ski. This, of course, results in higher speed at a given power input, and in a reduction in effort required from the skier.

In the presently preferred embodiment of the ski of the invention, the body of the ski is formed by two elongated sidewalls in a "deep Vee" configuration adjacent the bow, having upper edges that are separated to approximately the same width as conventional skis, and lower portions joined together along the bottom of the ski to form a relatively sharp keel. At the forward end of the ski, the sidewalls converge toward each other and the keel curves upwardly to a pointed forward end. The "V" cross-sectional shape has a progressively increasing angle through the mid and aft sections, so that the bottom becomes substantially flat at the aft end. Thus, the forward and mid sections remain effective in getting up, during acceleration, in crossing wakes and other waves, and to some extent during normal skiing, and the substantially flat aft section enhances maneuverability during normal skiing.

The footrest is in the mid section of the ski, and preferably is substantially level with the upper edges of the longitudinal sidewalls. Stirrups or bindings are mounted on the footrest to receive and releasably hold the feet of the skier in the usual positions on the ski.

Such skis may be mass-produced to sell at a competitive price, using conventional plastic molding techniques and presently available materials. Preferably, the body of the ski is molded as one piece of a suitable plastic such as structural urethane, and the footrest is the upper surface of a filling of similar material disposed between the sidewalls and secured thereto. This filling may be a buoyant plastic piece that is fitted into a molded ski body, or the entire ski, including the footrest filling, may be molded as one piece of buoyant material, such as structural urethane foam. Onepiece molding is preferred for economy of manufacture and simplicity and ruggedness of structure.

In its more detailed aspects, the ski of the invention has an upper side which is recessed in the fore section, for reduced weight and conservation of material. The preferred angle between the sidewalls of the fore section of the ski is on the order of 90° to 110°. In the mid-section, the angle exceeds one-hundred and thirty degrees, and in the aft section, the angle preferably becomes one-hundred and eighty degrees somwehat ahead of the aft end. For some purposes, the aft section may even be made concave, for a tunnel effect.

Other aspects and advantages of the invention will become apparent from the following detailed description, taken in conjunction with the accompanying drawings.

DETAILED DESCRIPTION OF THE PREFERRED EMBODIMENT

Figure 1:
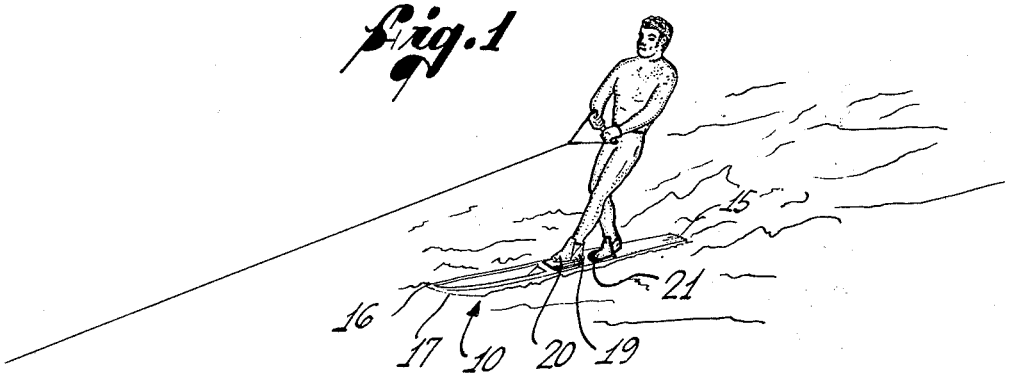
FIG. 1 is a perspective view of a water ski in accordance with the present invention, shown as worn by a skier.

As shown in the drawings for purposes of illustration, the water ski of the present invention, indicated generally by the reference number 10, has an elongated, relatively narrow body that is of V-shaped transverse cross-section in its forward and mid section, the "V" being formed by two elongated sidewalls 11 and 12 that are joined together along the keel 13 of the ski and have upper edges 14 that are spaced apart to form the top of the ski. The aft end 15 of the ski preferably is substantially squared off, and the forward end portion tapers to a point 16 at the upper end of an upwardly curving bow 17.

For convenience of reference, the body of the ski 10 may be regarded as having a fore section constituting roughly the forward one-third of its length, a mid section constituting roughly the central one-third, and an aft section constituting roughly the aft one-third. Formed in the mid section is a footrest 18, or step, upon which the skier stands, as shown in FIG. 1, this footrest having stirrups for releaseably holding the ski on the skier's feet. The illustrative stirrups include heel and toe pieces 19 and 20 for the front foot, and only a toe piece 21 for the rear foot. These pieces customarily are composed of flexible material such as rubber, and the heel piece 19 usually is slidable on the footrest to accommodate feet of different sizes. The stirrups may be basically conventional in construction.

Figure 2:
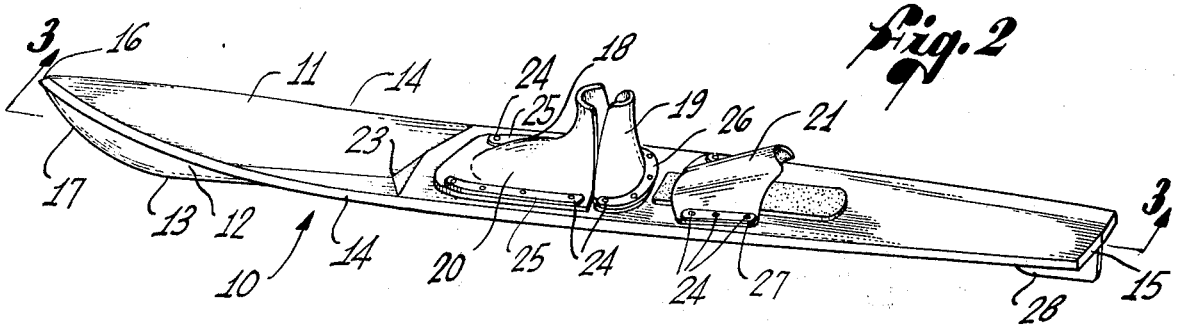
FIG. 2 is an enlarged perspective view of the ski alone.
Figure 3:
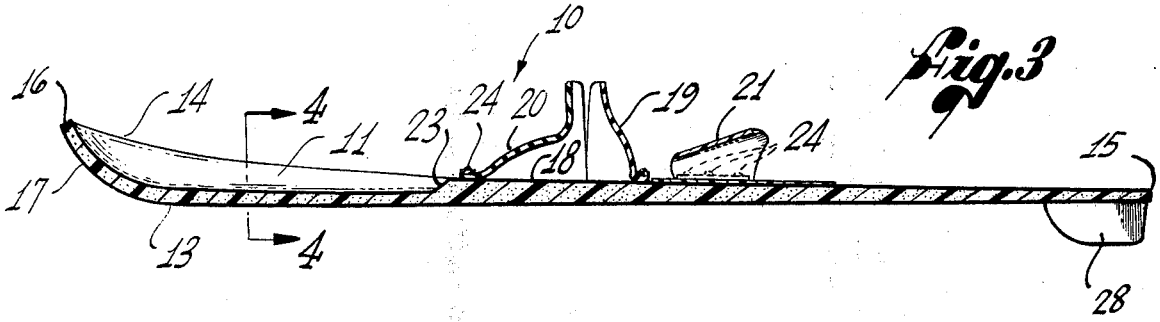
FIG. 3 is an enlarged longitudinal cross-sectional view taken substantially along line 3—3 of FIG. 2, with part of a stirrup broken away.

As shown most clearly in FIGS. 2 and 3, the footrest 18 is the upper surface of a filling that occupies approximately the aft two-thirds of the length of the ski and is fitted between the sidewalls 11 and 12, in the mid section, with the upper surface level with the upper edges 14 of the two sidewalls. The front end 23 of the filling is inclined forwardly and downwardly, while the rear end tapers into and becomes part of the body of the ski. In front of the footrest filling, the body has an elongated recess of V-shaped transverse cross-section extending to the bow.

The stirrup pieces 19, 20 and 21 are positioned on the flat top surface of the filling and are secured to the ski by suitable fasteners 24, such as screws driven into the filling through mounting strips 25, 26 and 27 of the stirrup pieces.

It can be seen in FIGS. 1 and 3 that the included angle between the outer sides of the sidewalls 11 and 12 in the operative part of the foresection, spaced from the bow 17, is relatively small, the preferred range being 90° to 110°, and the preferred angle being about 100°. The angle becomes somewhat smaller in the forward part of the fore section.

Figure 4:
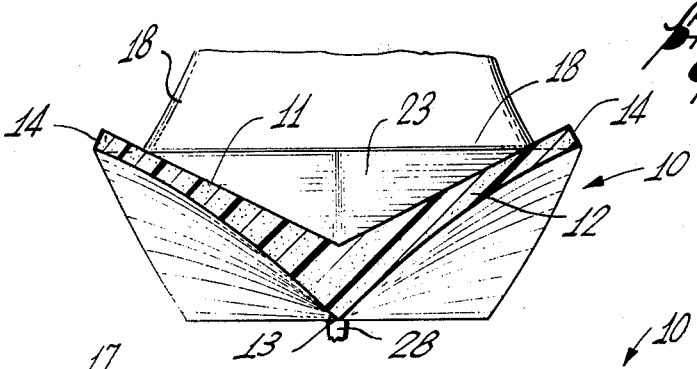
FIG. 4 is an enlarged transverse cross-sectional view taken along line 4—4 of FIG. 3, with part of the skeg broken away.
Figure 5:
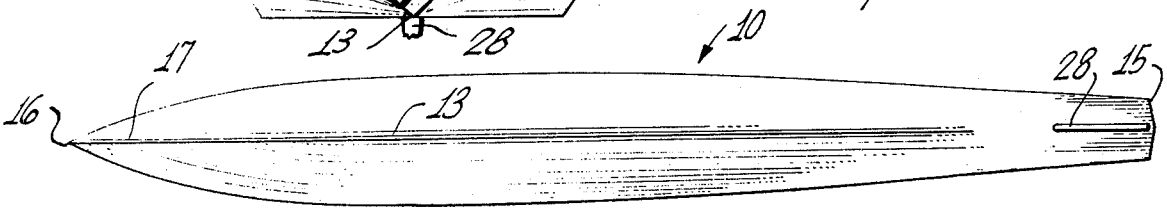
FIG. 5 is a bottom view of the ski.

As shown in FIG. 4, the angle increases progressively from the fore section, through the mid section, where it exceeds one-hundred and thirty degrees, and into the aft section, where it becomes substantially flat (180°) somewhat ahead of the aft end. As can be seen in FIG. 5, the keel 13 disappears where the bottom of the ski becomes flat. Where the characteristics of a tunnel-type ski are desired, this aft section can be made slightly concave. A conventional rudder or skeg 28 is provided on the flat aft portion of the ski.

Preferably, the outer sides of the V-shaped sidewalls 11 and 12 also are slightly concave in cross-section, as shown in FIG. 4. This provides improved performance in cutting through the water and directing the displaced water outwardly from the ski. The term "substantially flat", as used herein, is intended to include such moderate curvatures, as well as perfectly flat surfaces.

It will be seen that the spacing of the sidewalls 11 and 12 at the top of the ski is comfortably wider than the skier's feet. The maximum width of the body should be eight inches, for compliance with tournament rules, and the preferred width is about 7 inches. The ski can be made in conventional lengths and widths. For strength and durability, the thickness of the sidewalls 11 and 12 may be increased from the upper edges 14 toward the keel 13, as shown in FIG. 4.

The ski 10 of the invention has been designed to be molded of plastic in one piece, including the footrest filling as an integral part. Although the footrest is shown herein as flat, it will be apparent that shaped recesses (not shown) may be formed therein to receive the skier's feet. Such recesses can be provided in different sizes.

The finished ski 10 should be buoyant, and this can be accomplished by fabricating the entire ski of material that is lighter than water, preferably buoyant material such as urethane foam. This type of material can be injected in liquid state into a properly shaped die cavity (not shown) and cured in a short period of time to solid form, using known urethane molding techniques. Gas bubbles entrapped in the urethane foam reduce its weight sufficiently to make it buoyant.

As is well known in the aerospace industry, urethane foam materials have relatively high structural strength, and this strength is sufficiently high for use in water skis. Other plastic materials of relatively high strength (such as phenolic resin) can be used, with so-called micro-balloons to provide buoyancy. One suitable solid urethane material is that sold under the trademark Castathane, 2126N, by CPR Division of Upjohn Corporation, Torrance, California. A suitable urethane foam material sold by the same company is identified by the designation 741(16C).

A decorative and hard surface finish may be applied to the molded ski as an epoxy coating, if desired. So-called "self-skinning" foam material also can be used to eliminate the need for a finishing operation.

In general, it can be stated that the ski of the present invention has sidewalls which form a "warped plane" body, with a "deep Vee" fore section, a shallower "Vee" mid section, and an aft section in which the bottom becomes flat. This is accomplished by progressively and smoothly increasing the angle of divergence of the sidewalls from the fore section, through the mid section, and into the aft section, until those sidewalls are disposed substantially in the same plane.

The advantages of skis designed in accordance with the invention are similar to the advantages of so-called "deep Vee" boat hulls as compared to power boats with flatter bottom configurations. The latter type of bottom may develop greater initial lift during the initial stages of acceleration from a stop, by deflecting a mass of water downward across the full flat width of the hull, although this is not entirely certain in the case of water skis. In any event, even when starting, the resistive force to passage of the V-shaped ski through the water is considerably less, due to the more effective parting of the water by the sharper keel and the V-shaped portion of the body, and the initial strain on the skier will be correspondingly less.

Other important performance advantages of the V-shaped ski are found after the initial getting-up stage. When the angle of incidence of the ski reaches and the normal skiing attitude, with approximately the aft two-thirds of the ski wetted, the ski rises in the water with increases in speed, thereby reducing the wetted area of the ski due to the decreasing width toward the keel and the increasing lift generated by increasing speed. Accordingly, frictional resistance to passage of the ski through the water (drag) decreases correspondingly. Moreover, the downwardly tapered cross-section reduces impacts after jumps over wakes and in passing through choppy water. The result is a softer and more comfortable ride.

From the foregoing, it should be evident that the present invention provides a unique water ski that combines the advantages of V-shaped fore and mid sections with a flat aft portion, to achieve smoother skiing performance while maintaining normal skiing maneuverability. It also should be evident that modifications and changes in the specific embodiment shown may be made without departing from the spirit and scope of the invention.

What I claim:

1. A water ski, comprising:

an elongated, relatively narrow body having the length and width of a conventional water ski, the width being substantially uniform along the length of the ski, and only slightly wider than a skier's foot, and said body having a fore section, a mid section and an aft section, the fore and mid sections of said body being of V-shaped transverse cross-section;

said body being formed by two longitudinal sidewalls that are substantially flat in transverse cross-section and have laterally separated upper edges, and are joined together to form a relatively sharp keel along the bottom of said ski, the forward end portions of said sidewalls being curved upwardly to form a relatively sharp, upturned bow on said ski;

and a footrest in the mid section of said ski between said sidewalls and secured to the ski;

the angle of said sidewalls being a relatively small angle on the order of 90° to 110° in said fore section, increasing progressively through said mid section, and becoming substantially 180° in said aft section, whereby said ski has a substantially flat bottom surface in said aft section.

2. A water ski as defined in claim 1 in which said body is a one-piece plastic molding in which said sidewalls are integrally joined together.

3. A water ski as defined in claim 1 in which said body and said footrest are composed of structural urethane foam.

4. A water ski as defined in claim 1 in which the outer surfaces of said sidewalls are of slightly concave cross-sectional curvature.

5. A water ski as defined in claim 1 in which said ski has a longitudinal recess of V-shaped transverse cross-section in its upper side defined by the inner sides of said sidewalls from said footrest to said bow.

* * * * *

UNITED STATES PATENT AND TRADEMARK OFFICE

CERTIFICATE OF CORRECTION

PATENT NO. : 3,950,807

DATED : April 20, 1976

INVENTOR(S) : Roderick P. Sharpe

It is certified that error appears in the above-identified patent and that said Letters Patent are hereby corrected as shown below:

On the cover page, item [63], delete "1974" of the filing date and insert therefor --1973--.

Column 1, line 4, delete "1974" and insert therefor --1973--.

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*